US008979359B2

(12) United States Patent
Rochat

(10) Patent No.: US 8,979,359 B2
(45) Date of Patent: Mar. 17, 2015

(54) BALANCE SPRING WITH TWO HAIRSPRINGS

(75) Inventor: Jean-Philippe Rochat, Les Bioux (CH)

(73) Assignee: Montres Breguet S.A., L'Abbaye (CH)

( * ) Notice: Subject to any disclaimer, the term of this patent is extended or adjusted under 35 U.S.C. 154(b) by 26 days.

(21) Appl. No.: 13/609,858

(22) Filed: Sep. 11, 2012

(65) Prior Publication Data

US 2013/0064046 A1 Mar. 14, 2013

(30) Foreign Application Priority Data

Sep. 14, 2011 (EP) ..... 11181307

(51) Int. Cl.

| | |
|---|---|
| ***G04B 17/04*** | (2006.01) |
| ***G04B 17/34*** | (2006.01) |
| ***G04B 17/00*** | (2006.01) |
| ***G04B 17/32*** | (2006.01) |

(52) U.S. Cl.

CPC ..... *G04B 17/325* (2013.01)
USPC ..... 368/177; 368/175; 368/176; 368/178; 368/169

(58) Field of Classification Search

USPC ..... 368/169, 175–178
See application file for complete search history.

(56) References Cited

U.S. PATENT DOCUMENTS

| | | | | |
|---|---|---|---|---|
| 1,311,501 | A * | 7/1919 | Ecaubert | 368/178 |
| 3,306,026 | A * | 2/1967 | Kocher | 368/170 |
| 7,059,764 | B2 * | 6/2006 | Hintze et al. | 368/127 |
| 7,237,945 | B2 * | 7/2007 | Geyer | 368/178 |
| 7,293,913 | B2 * | 11/2007 | Peters et al. | 368/175 |
| 2006/0262652 | A1 * | 11/2006 | Musy et al. | 368/175 |
| 2007/0091729 | A1 * | 4/2007 | Takahashi | 368/170 |
| 2009/0245030 | A1 * | 10/2009 | Buhler et al. | 368/177 |
| 2010/0149927 | A1 * | 6/2010 | Zaugg et al. | 368/177 |
| 2011/0310710 | A1 * | 12/2011 | Karapatis et al. | 368/175 |
| 2012/0008467 | A1 * | 1/2012 | Helfer et al. | 368/171 |
| 2012/0176869 | A1 * | 7/2012 | Gonthier | 368/175 |
| 2013/0051191 | A1 * | 2/2013 | Schafroth | 368/175 |

FOREIGN PATENT DOCUMENTS

| | | | |
|---|---|---|---|
| CH | 76336 | | 12/1917 |
| CH | 347769 | | 7/1960 |
| EP | 1 780 611 | A2 | 5/2007 |
| EP | 1 798 609 | A2 | 6/2007 |
| EP | 1 850 193 | A1 | 10/2007 |
| EP | 2 105 807 | A1 | 9/2009 |
| EP | 2 405 312 | A1 | 1/2012 |
| FR | 2136084 | | 12/1972 |

OTHER PUBLICATIONS

European Search Report issued Mar. 28, 2012 in corresponding European Application No. 11 18 1307 filed on Sep. 14, 2011 (with an English Translation).

* cited by examiner

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A balance spring including a first hairspring, the inner coil of which includes a collet arranged to be mounted on a staff, and a second hairspring connected to the outer coil of the first hairspring by a raised terminal curve device. The inner coil of the second hairspring includes a device for shifting the pinning point including a free end arranged to be pinned up to a stud in the plane of the second hairspring.

14 Claims, 3 Drawing Sheets

BALANCE SPRING WITH TWO HAIRSPRINGS

This application claims priority from European Patent Application No. 11181307.7 filed Sep. 14, 2011, the entire disclosure of which is incorporated herein by reference.

FIELD OF THE INVENTION

The invention relates to a balance spring for a sprung balance resonator and more particularly to a balance spring comprising two hairsprings.

BACKGROUND OF THE INVENTION

Forming a balance spring using two hairsprings connected by a raised terminal curve device is known from EP Patent No. 2 405 312. This balance spring gives good results as regards the isochronism of the timepiece but may be problematic to mount in a timepiece movement if the free end of the balance spring, opposite to the end pinned up to the collet, is too close to the balance staff.

SUMMARY OF THE INVENTION

It is an object of the present invention to overcome all or part of the aforementioned drawbacks, by providing a balance spring with two hairsprings comprising a device for shifting the point of pinning up to the stud.

The invention therefore relates to a balance spring comprising a first hairspring, the inner coil of which includes a collet arranged to be mounted on a staff, a second hairspring connected to the outer coil of the first hairspring by a raised terminal curve device, characterized in that the inner coil of the second hairspring includes a device for shifting the pinning point comprising a free end arranged to be secured to a balance spring stud in the plane of said second hairspring.

It is therefore clear that the balance spring will be pinned up to the stud between two of its coils without, however, touching said coils during development, i.e. during both the contraction and expansion phases.

In accordance with other advantageous features of the invention:

- The shifting device includes a piece extending from the inner coil of the second hairspring, said piece being more rigid than said second hairspring to avoid providing elastic torque.
- The extension piece is connected to the inner coil via a substantially U-shaped bend.
- The extension piece is integral with the second hairspring.
- The extension piece is made more rigid by a thickness that is at least three times greater than that of said second hairspring.

The invention also relates to a movement comprising a sprung balance resonator including a balance rotatably fitted to a staff mounted between a plate and a bridge, characterized in that it includes a system of pinning up to the stud which cooperates with said free end of the balance spring according to any of the preceding variants, via a balance spring stud connecting said balance spring to said bridge.

In accordance with other advantageous features of the invention:

- The system of pinning up the balance spring to the stud includes a device for adjusting the stud, arranged between said stud and said bridge, to make the positioning of said stud adjustable.

- According to a first embodiment, the stud adjusting device includes a means of clamping said stud and a means of attachment to the bridge.
- The clamping means includes an elastic clamp controlled by a cam to selectively clamp said stud.
- The attaching means includes an attachment which cooperates in a friction tight fit against said bridge to enable the position of the stud to be adjusted relative to the bridge.
- The attachment forms two substantially annular arms intended to be attached to a cylindrical body of circular section of said bridge in order to alter the position of the stud concentrically to said staff.
- According to a second embodiment, the stud adjusting device includes a means of locking said stud and a means of attachment to the bridge.
- The locking means includes a part retaining one end of the stud against said means of attachment to the bridge in order to clamp said stud.
- The attaching means includes an attachment which is screwed against said bridge so that the position of the stud can be selectively adjusted relative to the bridge.
- The attachment includes a recess which slides against a cylindrical body of circular section of said bridge in order to alter the position of the stud concentrically to said staff.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
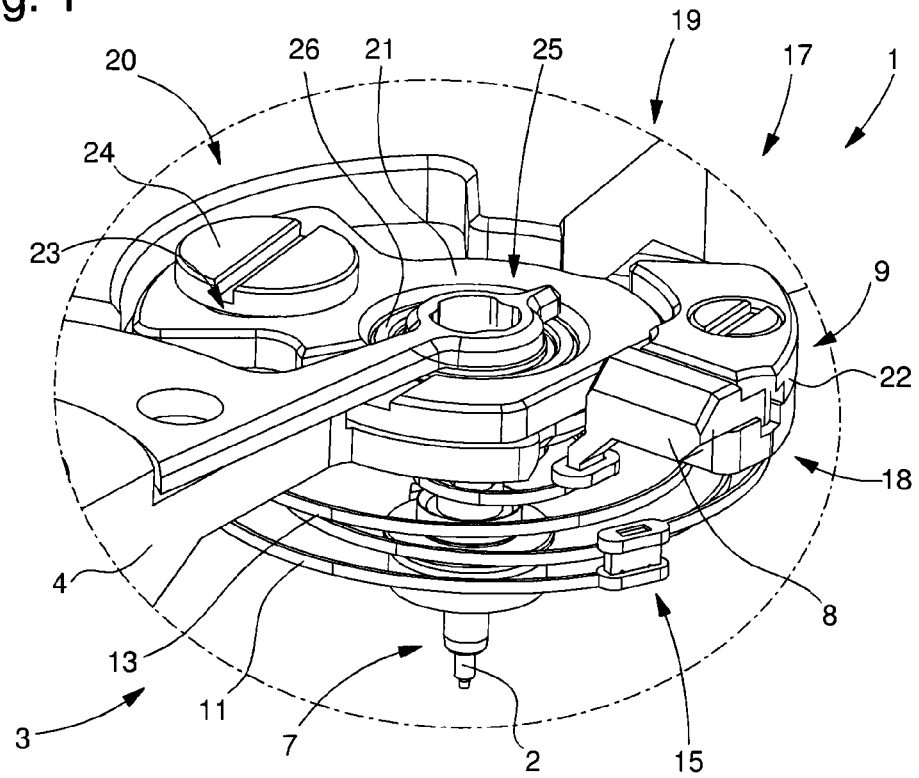
FIGS. 1 and 2 are perspective views of a first embodiment of a movement according to the invention.
Figure 2:
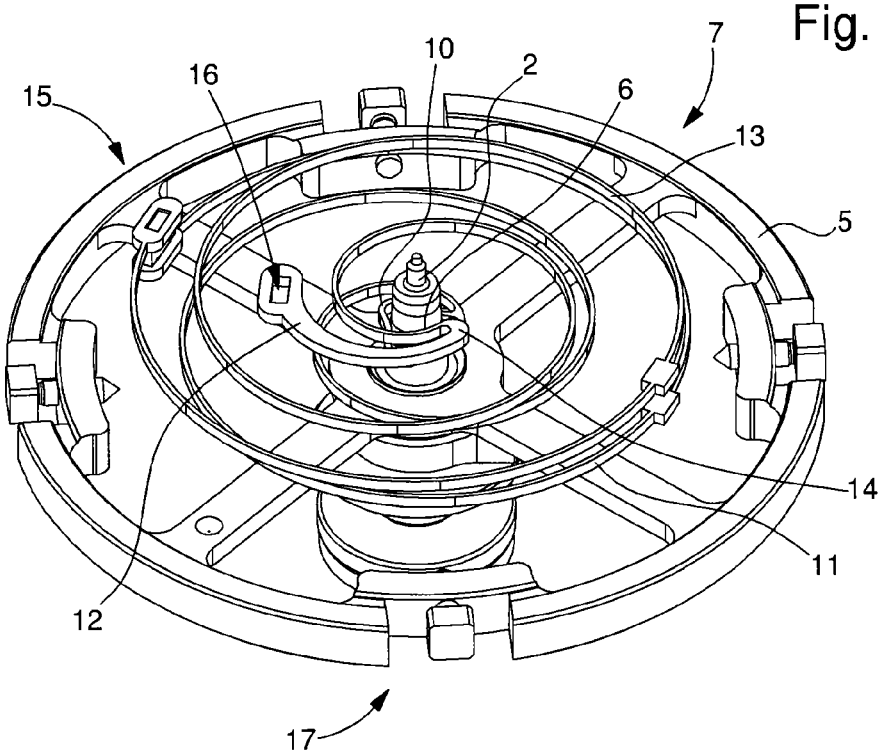

A first embodiment of a movement 1 according to the invention is presented in FIGS. 1 and 2. Movement 1 according to the invention is preferably intended to be mounted in a timepiece (not shown).

As seen in FIGS. 1 and 2, movement 1, which is preferably a timepiece movement, includes a resonator 3 of the sprung balance 7, 5 type. According to the invention, movement 1 includes a balance 5 rotatably fitted to a staff 2 mounted between a plate (not shown) and a bridge 4. In the example of FIG. 2, balance 5 is of the variable inertia type. It is clear that other types of balance may be used.

Advantageously according to the invention, movement 1 further includes a pinning system 9 intended to cooperate with a free end 6 of balance spring 7 via a balance spring stud 8 connecting balance spring 7 to bridge 4.

Preferably according to the invention, balance spring 7 includes a first hairspring 11, the inner coil of which comprises a collet 10, arranged to be mounted on staff 2, and a second hairspring 13 connected to the outer coil of the first hairspring 11 by a raised terminal curve device 15. The raised terminal curve device 15 between hairsprings 11 and 13 is preferably the device disclosed in CH Patent No. 0795/10 in the name of the Applicant. Moreover, balance spring 7 preferably follows the teaching of Patent No. CH 1144/10 also in the name of the Applicant and is therefore preferably made from a silicon base. CH Patent Nos. 0795/10 and 1144/10 are incorporated by reference in the present Application.

Further, the inner coil of the second hairspring 13 preferably comprises a device 17 for shifting the pinning point of the free end 6 arranged to be pinned up to a stud 8 in the plane of the second hairspring 13. Shifting device 17 is particularly useful for preventing particular shapes of balance spring 7 from making it impossible to assemble said balance spring due to the proximity of the free end 6 thereof to staff 2.

As seen in FIG. 2, shifting device 17 includes a piece 12 extending from the inner coil of the second hairspring 13. Preferably, piece 12 is more rigid than second hairspring 13 so as to avoid providing elastic torque to resonator 3. As seen more clearly in FIG. 2, piece 12 is preferably made more rigid by a greater thickness, such as for example at least three times greater, than the thickness of second hairspring 13, i.e. the width of the blade thereof. It is therefore clear that the shape of piece 12 is partly adapted according to the curve of the coils of second hairspring 13 so that no contact occurs.

Further, according to a particular alternative, it is preferable for piece 12 to be integral with second hairspring 13 and, preferably, for the height of said hairspring to be substantially equal to that of piece 12, i.e. contained within the same plane.

The extension piece 12 is further preferably connected to the inner coil of second hairspring 13 via a substantially U-shaped bend 14 in order to further limit the supply of any elastic torque. It is clear that extension piece 12 and bend 14 potentially bring closer the fixed point formed by bridge 4 at free end 6 of balance spring 7.

Finally, in the first embodiment of FIGS. 1 and 2, piece 12 has a recess 16, which may be a blind or through recess, of substantially rectangular section, intended to cooperate with pinning system 9 and, more precisely, stud 8.

Pinning system 9 preferably includes a device 19 for adjusting the stud 8 mounted between said stud and bridge 4 to make the position thereof adjustable. Adjusting device 19 preferably includes a means 18 of locking stud 8 and a means 20 of attachment to bridge 4.

Preferably according to the invention, locking means 18 includes a part 22 retaining one end of stud 8 against said means of attachment 20 (in the example of FIG. 1, attachment 21) in order to clamp stud 8. In the example illustrated in FIG. 1, the end of stud 8 is L-shaped and locked in a groove of attachment 21 by the overlapping part 22, which is screwed against attachment 21.

Means of attachment 20 preferably includes attachment 21, which is intended to be screwed and locked against bridge 4 so that the position of stud 8 can be selectively adjusted relative to bridge 4. This is made possible by the oblong hole 23 made in attachment 21 which receives the shaft of screw 24, which cooperates with bridge 4. It is thus clear that attachment 21 can be locked in several positions by sliding the shaft of screw 24 into hole 23 before it is screwed in.

Finally, attachment 21 includes a recess 25 intended to slide against a cylindrical body 26 of circular section of bridge 4 so as to alter the position of stud 8 concentrically to staff 2. In the example illustrated in FIG. 1, it can be seen that cylindrical body 26 is a portion of the shock absorber bearing of movement 1. Preferably according to the invention, the shock absorber bearing is that disclosed in CH Patent No. 0720/05 in the name of the Applicant and incorporated by reference in this Patent Application.

As seen in FIG. 1, in order to fit attachment 21 to said shock absorber bearing, it is noted that a recess has been made so that the elastic arm operates properly. It is thus clear that any required modifications can be made to shifting device 17 or pinning system 9 in order to fit other components of movement 1.

Consequently, movement 1 according to the first embodiment includes a double balance spring 7 which is secured to bridge 4 by pinning system 9, allowing preferably concentric adjustment of the position of stud 8 relative to staff 2.

A second embodiment of a movement 31 according to the invention is shown in FIGS. 3 to 6. Movement 31 according to the invention is preferably intended to be mounted in a timepiece (not shown).

Figure 3:
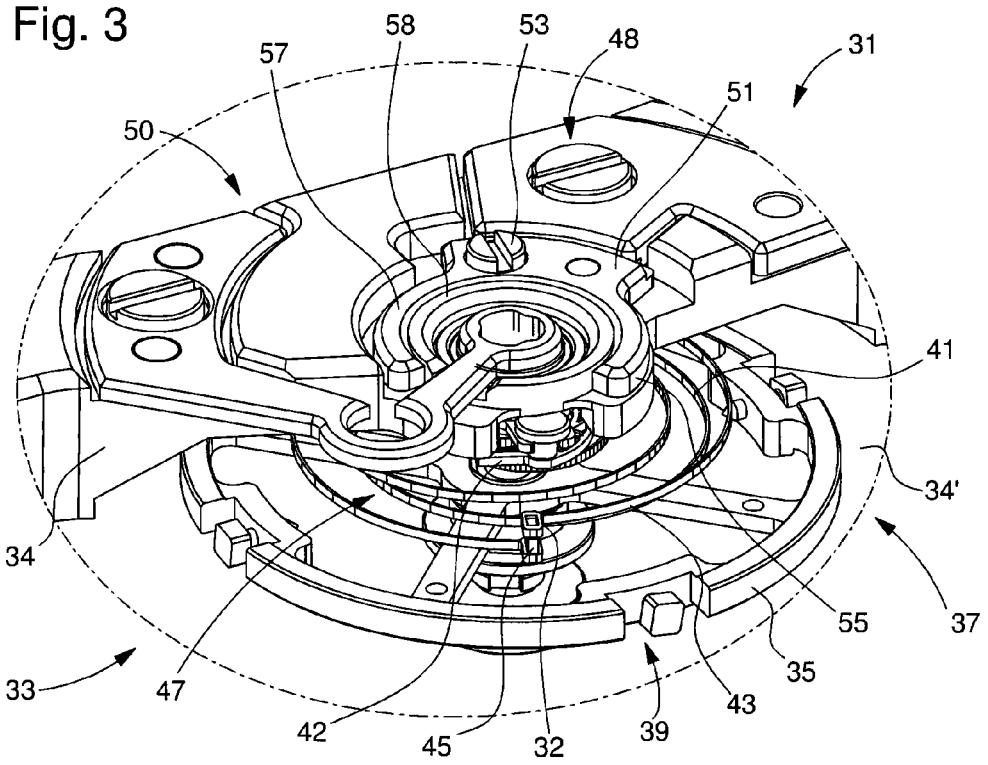
FIGS. 3 to 6 are perspective views of a second embodiment of a movement according to the invention.
Figure 6:
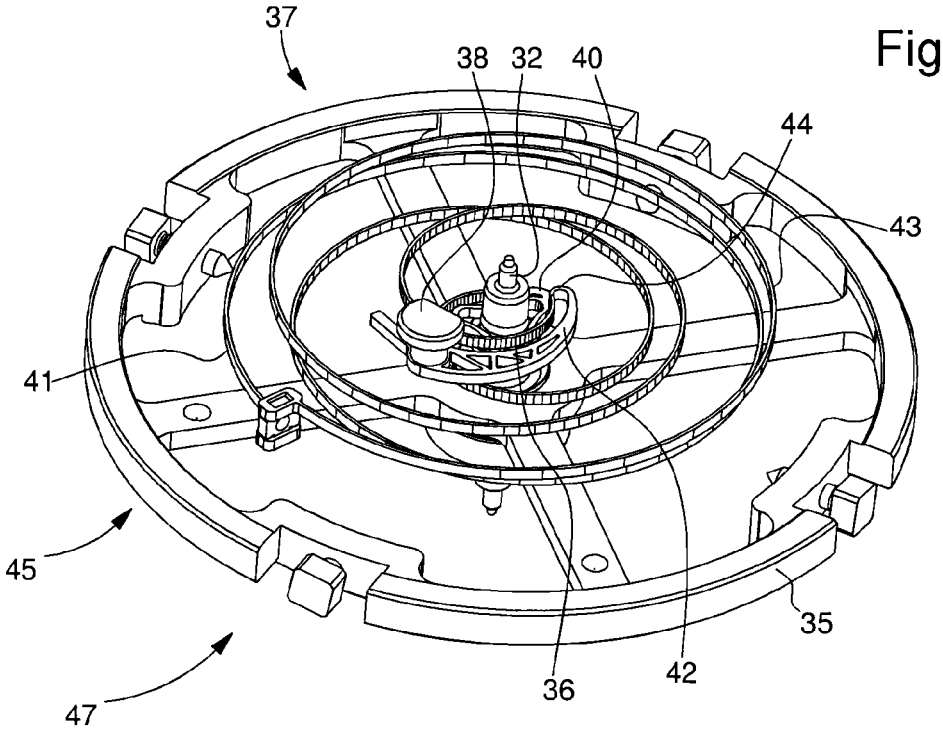

As seen in FIGS. 3 and 6, movement 31, which is preferably a timepiece movement, includes a resonator 33 of the sprung balance 37, 35 type. According to the invention, movement 31 includes a balance 35 rotatably fitted to a staff 32 mounted between a plate 34' and a bridge 34. In the example of FIGS. 3 and 6, balance 35 is of the variable inertia type. It is clear that other types of balance may be used.

Advantageously according to the invention, movement 31 further includes a pinning system 39 intended to cooperate with a free end 36 of balance spring 37 via a balance spring stud 38 connecting balance spring 37 to bridge 34.

Preferably according to the invention, balance spring 37 includes a first hairspring 41, the inner coil of which comprises a collet 40, arranged to be mounted on staff 32, and a second hairspring 43 connected to the outer coil of the first hairspring 41 by a raised terminal curve device 45. The raised terminal curve device 45 between hairsprings 41 and 43 is preferably the device disclosed in CH Patent No. 0795/10 in the name of the Applicant. Moreover, balance spring 37 preferably follows the teaching of Patent No. CH 1144/10 also in the name of the Applicant and is therefore preferably made from a silicon base. CH Patent Nos. 0795/10 and 1144/10 are incorporated by reference in the present Application.

Further, the inner coil of the second hairspring 43 preferably comprises a device 47 for shifting the pinning point of the free end 36 arranged to be pinned up to a stud 38 in the plane of the second hairspring 43, which is comparable to that of the first embodiment. Shifting device 47 is particularly useful for preventing particular shapes of balance spring 37 from making it impossible to assemble said balance spring due to the proximity of the free end 36 thereof to staff 32.

Figure 4:
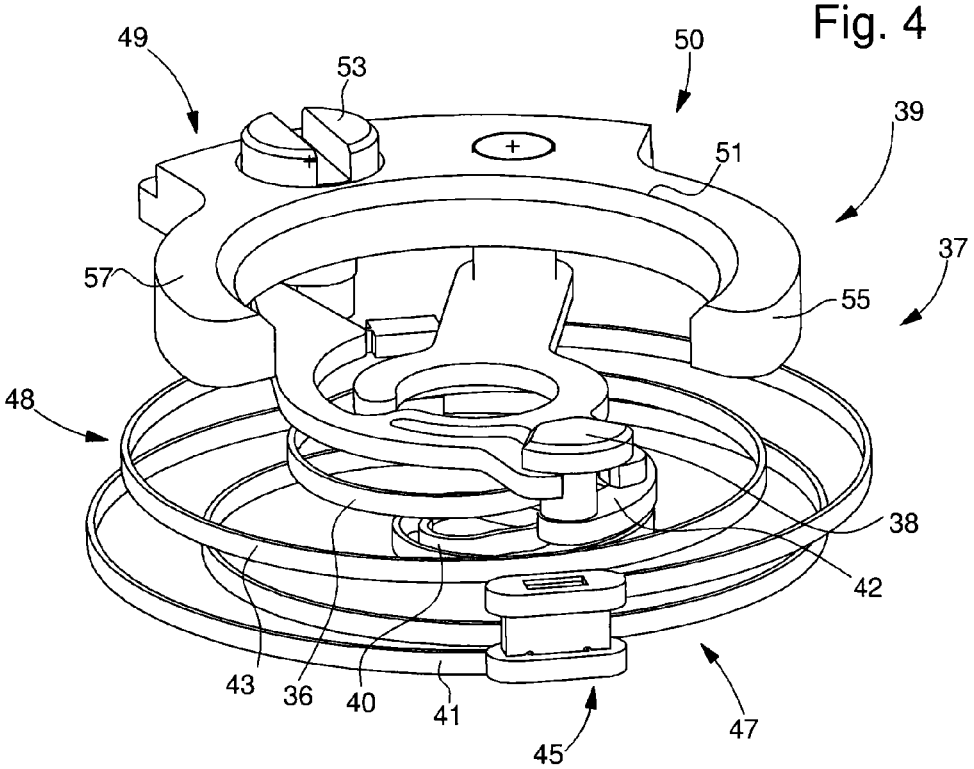
Figure 5:
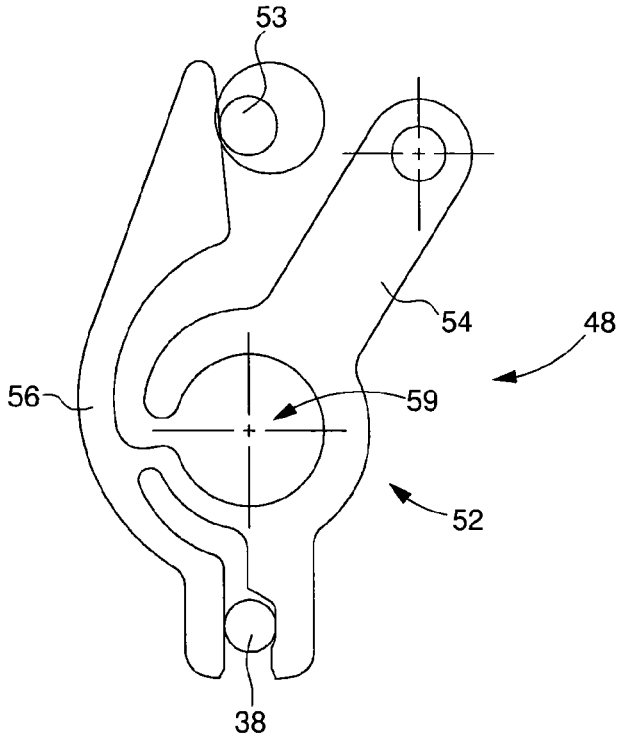

As seen in FIG. 4, shifting device 37 includes a piece 42 extending from the inner coil of the second hairspring 43. Preferably, piece 42 is more rigid than second hairspring 43 so as to avoid providing elastic torque to resonator 33. As seen more clearly in FIG. 4, piece 42 is preferably made more rigid by a greater thickness, such as for example at least three times greater, than the thickness of second hairspring 43, i.e. the width of the blade thereof. It is therefore clear that the shape of piece 42 is partly adapted according to the curve of the coils of second hairspring 43 so that no contact occurs.

Further, according to a particular alternative illustrated in FIG. 6, it is preferable for piece 42 to be integral with second hairspring 43 and, preferably, for the height of said hairspring to be substantially equal to that of piece 42, i.e. contained within the same plane. It is also noted that extension piece 42 is advantageously pierced with holes to reduce the mass thereof but without reducing its rigidity.

Extension piece 42 is also preferably connected to the inner coil of the second hairspring 43 via a substantially U-shaped bend 44 in order to further limit the supply of any elastic torque with the same advantages as in the first embodiment.

Finally, in the second embodiment of FIGS. 3 to 6, piece 42 has a recess 16, which may be a blind or through recess, of substantially rectangular section, intended to cooperate with pinning system 39 and, more precisely, stud 38.

Pinning system 39 preferably includes a device 49 for adjusting the stud 38 mounted between said stud and bridge 34 to make the position of stud 38 adjustable. Adjusting device 49 preferably includes a means 48 of clamping stud 38 and a means 50 of attachment to bridge 34.

Preferably according to the invention, clamping means 48 includes an elastic clamp 52 controlled by a cam 53 in order to clamp stud 38 selectively. In the example illustrated in FIGS. 4 and 5, clamp 52 is formed by a fixed portion 54 relative to means of attachment 50 and, more particularly to attachment 51, and includes a hole 59 for contactlessly receiving staff 32.

Clamp 52 also includes a mobile portion 56 elastically connected to fixed portion 54 and controlled by cam 53. It is thus clear that, in the FIG. 5 view, clamping means 48 is in the position where cam 53 induces maximum force and consequently means 48 clamps stud 38 in a friction tight fit preventing the stud from imparting any relative movement with respect to clamping means 48. Of course, the contact surfaces between clamping means 48 and stud 38 may be changed, for example grooved and/or fluted, in order to further limit said relative movement.

Means of attachment 50 preferably includes an attachment 51 intended to cooperate in a friction tight fit against bridge 34 so that the position of stud 38 can be adjusted with respect to bridge 34. For this purpose, attachment 51 forms two substantially annular arms 55, 57 intended to be attached against a cylindrical body 58 of circular section of bridge 34 in order to alter the position of stud 38 concentrically to staff 32. It is thus clear that attachment 51 may be locked in several positions by moving each arm 55, 57 against body 58.

In the example illustrated in FIG. 3, it can be seen that cylindrical body 58 is a portion of the shock absorber bearing of movement 31. Preferably according to the invention, the shock absorber bearing is that disclosed in CH Patent No. 0720/05 in the name of the Applicant and incorporated by reference in this Patent Application.

As in the first embodiment, is of course clear that any required modifications can be made to shifting device 47 or pinning system 39 in order to fit other components of movement 31.

Consequently, movement 31 according to the second embodiment includes a double balance spring 37, which is secured to bridge 34 by pinning system 39, allowing preferably concentric adjustment of the position of stud 38 relative to staff 32. Compared to the first embodiment, it is clear that the second embodiment allows resonator 33 to be more accessible and more visible.

Of course, this invention is not limited to the illustrated example but is capable of various variants and alterations that will appear to those skilled in the art. In particular, it is possible to envisage piece 12 being partially pierced with holes to decrease its mass as for piece 42. Moreover, as for pieces 12, 42, it is possible to envisage that a more rigid part exists between collet 10, 40 and the first hairspring 11, 41 in order to optimise the development of balance spring 7, 37.

What is claimed is:

1. A balance spring comprising:

a first hairspring having an outer coil and an inner coil, the inner coil including a collet arranged to be mounted on a staff; and a second hairspring connected to the outer coil of the first hairspring by a raised terminal curve device and terminating at a pinning point on a free end of the balance spring, the second hairspring having an inner coil that includes a shifting device for shifting the pinning point of the free end of the balance spring, the free end being arranged to be secured to a balance spring stud in a plane of said second hairspring, and the shifting device including an extension piece connected to the inner coil of the second hairspring via a substantially u-shaped bend extending from the inner coil of the second hairspring to avoid providing elastic torque.

2. The balance spring according to claim 1, wherein the extension piece is more rigid than said second hairspring to avoid providing elastic torque.

3. The balance spring according to claim 1, wherein the extension piece is integral with the second hairspring.

4. The balance spring according to claim 3, wherein the extension piece is made more rigid by having a thickness that is at least three times greater than a thickness of said second hairspring.

5. A movement comprising:

a sprung balance resonator including a balance rotatably fitted to a staff mounted between a plate and a bridge; and a pinning system cooperating with a free end of a balance spring according to claim 1, via a balance spring stud connecting said balance spring to said bridge.

6. The movement according to claim 5, wherein the pinning system includes a stud adjusting device for adjusting the balance spring stud mounted between said balance spring and said bridge to make a position of said balance spring stud adjustable.

7. The movement according to claim 6, wherein the stud adjusting device for adjusting the balance spring stud includes means of clamping said balance spring stud and means of attachment to the bridge.

8. The movement according to claim 7, wherein the means of clamping includes an elastic clamp controlled by a cam in order to selectively clamp said balance spring stud.

9. The movement according to claim 7, wherein the means of attachment includes an attachment intended to cooperate in a friction tight fit against said bridge to enable the position of the balance spring stud to be adjusted relative to the bridge.

10. The movement according to claim 9, wherein the attachment forms two substantially annular arms intended to be attached to a cylindrical body of circular section of said bridge in order to alter the position of the balance spring stud concentrically to said staff.

11. The movement according to claim 6, wherein the stud adjusting device includes means of locking said balance spring stud and means of attachment to the bridge.

12. The movement according to claim 11, wherein the means of locking includes a part retaining one end of the balance spring stud against said means of attachment to the bridge in order to clamp said balance spring stud.

13. The movement according to claim 11, wherein the means of attachment includes an attachment intended to be screwed against said bridge so that the position of the balance spring stud can be selectively adjusted relative to the bridge.

14. The movement according to claim 13, wherein the attachment includes a recess intended to slide against a cylindrical body of circular section of said bridge in order to alter the position of the balance spring stud concentrically to said staff.

* * * * *